US005675655A

United States Patent [19]

Hatae

[11] Patent Number: 5,675,655

[45] Date of Patent: Oct. 7, 1997

[54] SOUND INPUT APPARATUS

[75] Inventor: Shinichi Hatae, Kanagawa-ken, Japan

[73] Assignee: Canon Kabushiki Kaisha, Tokyo, Japan

[21] Appl. No.: 419,378

[22] Filed: Apr. 10, 1995

[30] Foreign Application Priority Data

Apr. 28, 1994 [JP] Japan ..... 6-092198

[51] Int. Cl.[6] ..... H04R 5/00; H04R 3/00

[52] U.S. Cl. ..... 381/26; 381/92; 381/111; 381/122; 367/126

[58] Field of Search ..... 381/26, 92, 94, 381/95, 97, 98, 122, 111, 93, 168, 169, 81; 367/126

[56] References Cited

U.S. PATENT DOCUMENTS

| | | | |
|---|---|---|---|
| 4,223,400 | 9/1980 | Zalesak et al. | 367/126 |
| 4,334,740 | 6/1982 | Wray | 381/92 |
| 4,354,059 | 10/1982 | Ishigaki et al. | 381/92 |
| 4,466,117 | 8/1984 | Görike | 381/26 |
| 4,703,506 | 10/1987 | Sakamoto et al. | 367/126 |
| 5,029,215 | 7/1991 | Miller, II | 381/92 |
| 5,193,117 | 3/1993 | Ono et al. | 381/92 |
| 5,206,910 | 4/1993 | Hamada et al. | 381/26 |
| 5,214,709 | 5/1993 | Ribic | 381/92 |
| 5,226,087 | 7/1993 | Ono et al. | 381/26 |
| 5,303,307 | 4/1994 | Siko et al. | 381/92 |
| 5,400,409 | 3/1995 | Linhard | 381/92 |
| 5,471,538 | 11/1995 | Sasaki et al. | 381/92 |
| 5,473,701 | 12/1995 | Cezanne et al. | 381/92 |
| 5,477,270 | 12/1995 | Park | 381/92 |
| 5,483,599 | 1/1996 | Zagorski | 381/92 |

FOREIGN PATENT DOCUMENTS

| | | | |
|---|---|---|---|
| 0217100 | 8/1990 | Japan | 381/26 |

*Primary Examiner*—Curtis Kuntz
*Assistant Examiner*—Xu Mei
*Attorney, Agent, or Firm*—Robin, Blecker, Daley and Driscoll

[57] ABSTRACT

A sound input apparatus according to the present invention subtracts, from the output signal from a first microphone, the output signal of a second microphone which is arranged in a manner different from that of the first microphone to output the subtracted signal and controls the level of the signal of the second microphone in response to the level of the subtracted signal. The sound input apparatus simply constructed in this way achieves a narrowed sound directivity when picking up sound and presents high-quality audio signal while keeping the influence of ambient noise to a minimum.

15 Claims, 6 Drawing Sheets

SOUND INPUT APPARATUS

BACKGROUND OF THE INVENTION

1. Field of the Invention

This invention relates to a sound input apparatus for inputting sound.

2. Description of the Related Art

FIG. 1 is a block diagram showing a stereophonic sound input apparatus employing an MS (Mid-Side) microphone system. The apparatus in FIG. 1 is constructed of a mid-microphone 1 (hereinafter referred to as M microphone), and side microphones 2 (hereinafter referred to as S microphones) consisting of a pair of an S microphone 2R for the right channel and an S microphone 2L for the left channel.

FIG. 2 shows directivity patterns of the M microphone 1 and S microphones 2. Each of the S microphones 2L and 2R has its peak directivity angled at 90° with respect to the peak of the directivity of the M microphone 1.

The apparatus in FIG. 1 further comprises an inverter 3 for inverting the output of the S microphone 2R, an adder 5 for adding the output of the S microphone 2L and the output of the inverter 3, a variable amplifier 8 for amplifying the sum signal of the adder 5 by (1–K) times, a variable amplifier 6 for amplifying the output of the M microphone 1 by K times, an adder 22 for adding the output of the variable amplifier 6 and the output of the variable amplifier 8, an output terminal 11 for providing the output of the adder 22 as an R signal, a subtracter 23 for subtracting the output of the variable amplifier 8 from the output of the variable amplifier 6, and an output terminal 13 for providing the output of the subtracter 23 as an L signal.

The operation of the apparatus is now discussed.

The adder 5 gives an output signal (L–R) when it is fed with the output of the S microphone 2L and the output of the S microphone 2R after it is inverted through the inverter 3. The signal (L–R) is then amplified (multiplied) by the variable amplifier 8 by (1–K) times and the amplified signal is then sent to both the adder 22 and the subtracter 23.

The output signal (L+R) derived from the M microphone 1 is amplified by the variable amplifier 6 by K times and then sent to both the adder 22 and the subtracter 23. As a result, the adder 22 outputs the R signal at the output terminal 11. The subtracter 23 outputs the L signal at the output terminal 13.

In such a stereophonic sound input apparatus employing an MS type microphone system, its directivity characteristics may be modified by changing the coefficient K of the variable amplifiers 6, 8.

Although in the above-mentioned stereophonic sound input apparatus, the change of the coefficient K of the variable amplifiers 6, 8 modifies the directivity of the apparatus, it cannot be set to be narrower than the single directivity pattern of the M microphone 1 (FIG. 2) when a narrow directivity mode is selected. Furthermore, when the narrow directivity mode is utilized, the M microphone 1 picks up ambient noise, causing the resulting directivity to widen equivalently.

SUMMARY OF THE INVENTION

It is one object of the present invention to provide a sound input apparatus which resolves the above-mentioned problems.

It is yet another object of the present invention to provide a sound input apparatus which achieves a narrowed directivity in picking up sound with its simple construction and results in an excellent quality audio signal without being influenced by ambient noise.

In view of the above objects, the sound input apparatus according to the present invention comprises, in its one aspect, first sound pick-up means for converting sound into an electrical signal, second sound pick-up means, disposed in a manner different from that of the first sound pick-up means, for converting sound into an electrical signal, subtraction means for outputting a signal obtained by subtracting an output of the second sound pick-up means from an output of the first sound pick-up means, and level control means for controlling the level of the signal outputted from the second sound pick-up means in accordance with the level of the signal outputted from the subtraction means.

It is yet a further object of the present invention to provide a sound input apparatus which offers a variable directivity capability in picking up sound with its simple construction to narrow the directivity depending on the purpose of an application.

To achieve the above object, the sound input apparatus according to the present invention comprises, in its one aspect, a first microphone disposed to allow its maximum directivity to be oriented in a desired direction, first coefficient multiplying means for multiplying a signal outputted from the first microphone by an arbitrary coefficient to output a resultant signal, a pair of second microphones disposed to allow their maximum directivities to be oriented in directions different from the direction of the maximum directivity of the first microphone, arithmetic processing means for performing an adding or a subtracting operation between outputs of the second microphones to output a resultant signal, second coefficient multiplying means for multiplying the signal outputted from the arithmetic processing means by an arbitrary coefficient to output a resultant signal, subtraction means for outputting as a first channel signal a signal obtained by subtracting the signal outputted from the second coefficient multiplying means from the signal outputted from the first coefficient multiplying means, addition means for outputting as a second channel signal a signal obtained by adding the signal outputted from the second coefficient multiplying means and the signal outputted from the first coefficient multiplying means, and setting means provided with a first sound pick-up mode in which sound is picked up in a first directivity and a second sound pick-up mode in which sound is picked up in a second directivity which is narrower than the first directivity, for performing the setting corresponding to either of the two sound pick-up modes, wherein said setting means, in the first sound pick-up mode, sets the arithmetic processing means to output a signal obtained by performing a subtracting operation between the outputs of the second microphones, and said setting means, in the second sound pick-up mode, sets the arithmetic processing means to output a signal obtained by performing an adding operation between the outputs of the second microphones, allows the subtraction means to output, as a first channel signal and a second channel signal, a signal obtained by subtracting the signal outputted from the second coefficient multiplying means from the signal outputted from the first coefficient multiplying means, and allows the second coefficient multiplying means to output a signal obtained by multiplying the signal outputted from the arithmetic processing means by a coefficient corresponding to the level of the signal outputted from the subtraction means.

It is yet a further object of the present invention to provide a sound input apparatus which is capable of picking up sound without being influenced by ambient noise and outputting an excellent-quality audio signal.

To achieve the above object, the sound input apparatus according to the present invention comprises, in its one aspect, a first microphone disposed to allow its maximum directivity to be oriented in a desired direction, first coefficient multiplying means for multiplying a signal outputted from the first microphone by an arbitrary coefficient to output a resultant signal, a pair of second microphones disposed to allow their maximum directivities to be oriented in directions different from the direction of the maximum directivity of the first microphone, arithmetic processing means for performing an adding or a subtracting operation between outputs of the second microphones to output a resultant signal, second coefficient multiplying means for multiplying the signal outputted from the arithmetic processing means by an arbitrary coefficient to output a resultant signal, filter means for filtering the signal outputted from the second coefficient multiplying means to output a resultant signal, subtraction means for outputting as a first channel signal a signal obtained by subtracting the signal outputted from the filter means from the signal outputted from the first coefficient multiplying means, addition means for outputting as a second channel signal a signal obtained by adding the signal outputted from the filter means and the signal outputted from the first coefficient multiplying means, and setting means provided with a first sound pick-up mode in which sound is picked up in a first directivity and a second sound pick-up mode in which sound is picked up in a second directivity which is narrower than the first directivity, for performing the setting corresponding to either of the two sound pick-up modes, wherein said setting means, in the first sound pick-up mode, sets the arithmetic processing means to output a signal obtained by performing a subtracting operation between the outputs of the second microphones, and said setting means, in the second sound pick-up mode, sets the arithmetic processing means to output a signal obtained by performing an adding operation between the outputs of the second microphones, allows the subtraction means to output, as a first channel signal and a second channel signal, a signal obtained by subtracting the signal outputted from the filter means from the signal outputted from the first coefficient multiplying means, and allows the filter means to output a signal obtained by filtering the signal outputted from the second coefficient multiplying means according to a filter characteristic corresponding to the level of the signal outputted from the subtraction means.

These and other objects and advantages will become more apparent when the following detailed description of the invention is considered with the accompanying drawings.

DETAILED DESCRIPTION OF THE PREFERRED EMBODIMENTS (First Embodiment)

Figure 3:
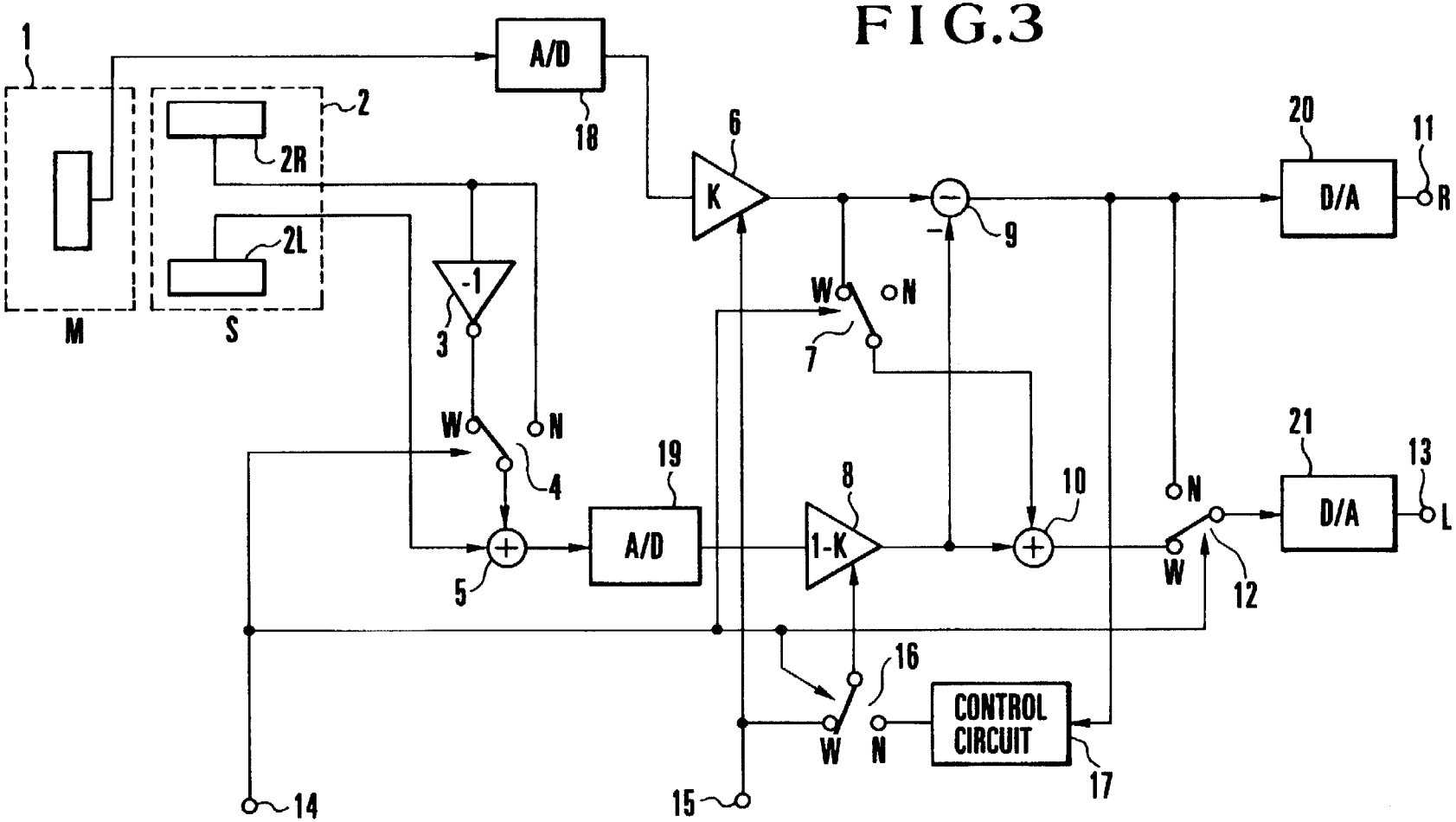
FIG. 3 is a block diagram showing diagrammatically the construction of a first embodiment of the sound input apparatus according to the present invention.

FIG. 3 is a block diagram showing the first embodiment of the present invention. In the embodiment, the outputs of the microphones are analog-to-digital converted before being processed.

Figure 1:
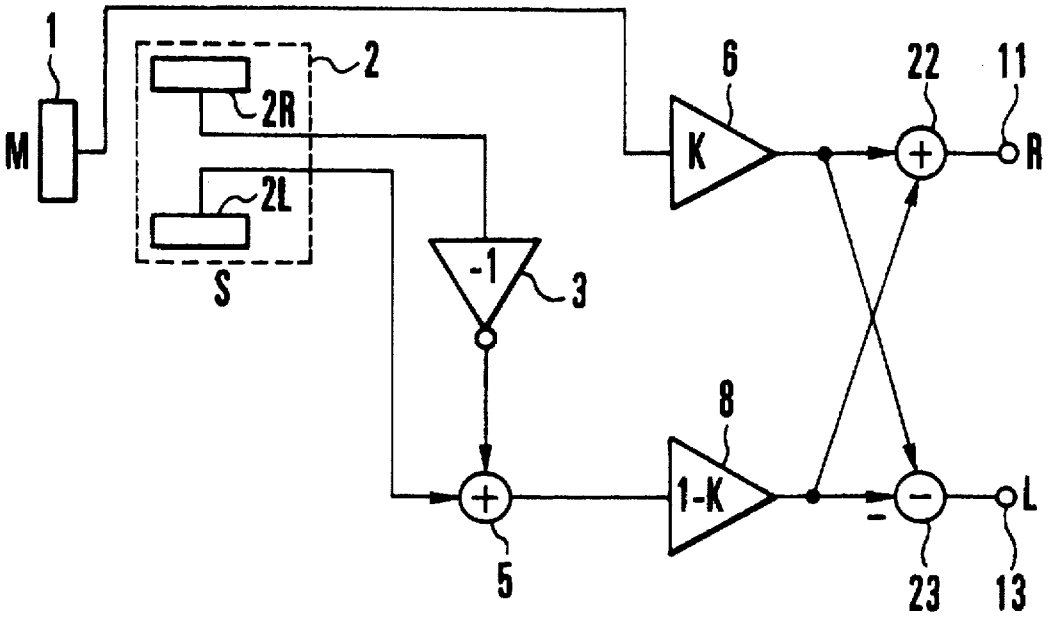
FIG.1 (PRIOR ART)
FIG. 1 is a block diagram showing the stereophonic sound input apparatus employing a conventional MS (Mid-Side) type microphone system.

In FIG. 3, those components equivalent to those described with reference to FIG. 1 are designated with the same reference numerals, and their description is omitted.

In FIG. 3, before it is fed to a variable amplifier 6, the output signal of the M microphone 1 is converted into a digital signal by an A/D converter 18. The sum signal of the adder 5 is converted into a digital signal by an A/D converter 19 and then fed to a variable amplifier 8. A digital signal R is converted into a analog signal R by a D/A converter 20 and then sent to an output terminal 11, and a digital signal L is converted into an analog signal L by a D/A converter 21 and then sent to an output terminal 13.

There are provided switches 4, 7, 12 and 16, each of which is fed with a switch signal via a switch control terminal 14 to be switched between its W position and N position. The letter W stands for wide directivity mode and the letter N stands for narrow directivity mode.

A subtracter 9 is coupled to the output side of the variable amplifier 6 while an adder 10 is coupled to the output side of the variable amplifier 8. The output of the subtracter 9 is sent to a control circuit 17 as an error signal to be described later. A coefficient control signal is fed through a coefficient control terminal 15 to control a coefficient K of the variable amplifiers 6, 8.

The operation of the apparatus constructed as above is discussed.

In the wide directivity mode operation, the switches 4, 7, 12 and 16 are set to their W positions. The signal (L+R) of the M microphone 1 is converted into the digital signal via the A/D converter 18 and fed to the variable amplifier 6 where the digital signal is amplified by K times. The amplified digital signal is sent to the subtracter 9 and to the adder 10 via the position W of the switch 7.

A pair of S microphones 2L, 2R are positioned in a manner that both are oriented opposite to each other in their directivities. The output of the S microphone 2R is fed via an inverter 3 and the position W of the switch 4 to the adder 5 where a difference between the output of the S microphone 2R and the output of the S microphone 2L is obtained. The adder 5 thus outputs the difference component signal as a signal (L−R). The signal (L−R) is converted into the digital signal by the A/D converter 19, fed to the variable amplifier 8 to be amplified by (1−K) times. The amplified signal is fed to both the subtracter 9 and the adder 10.

The output of the subtracter 9 is D/A converted into the analog signal by the D/A converter 20, and then provided as the signal R at the output terminal 11. The output of the adder 10 is fed to the D/A converter 21 to be converted into the analog signal, and the analog signal appears as the signal L at the output terminal 13.

The control signal fed via the coefficient control terminal 15 controls the coefficient K of the variable amplifiers 6, 8. The variation of the coefficient K changes the ratio of the level of the signal (L+R) of the M microphone 1 to the level of the signal (L−R) of the S microphones 2, as expressed in the following equations. By allowing the coefficient K ($0 \leqq K \leqq 1$) to continuously vary, the combined directivity of the MS microphones is controlled.

Assuming the output of the M microphone, Ms=(L+R) and the output of the S microphones, Ss=(L−R), left and right channel outputs, Lch and Rch, are expressed as follows:

$$Lch=K*(Ms)+(1-K)*(Ss)$$

$$Rch=K*(Ms)+(1-K)*(Ss)$$

Figure 2:
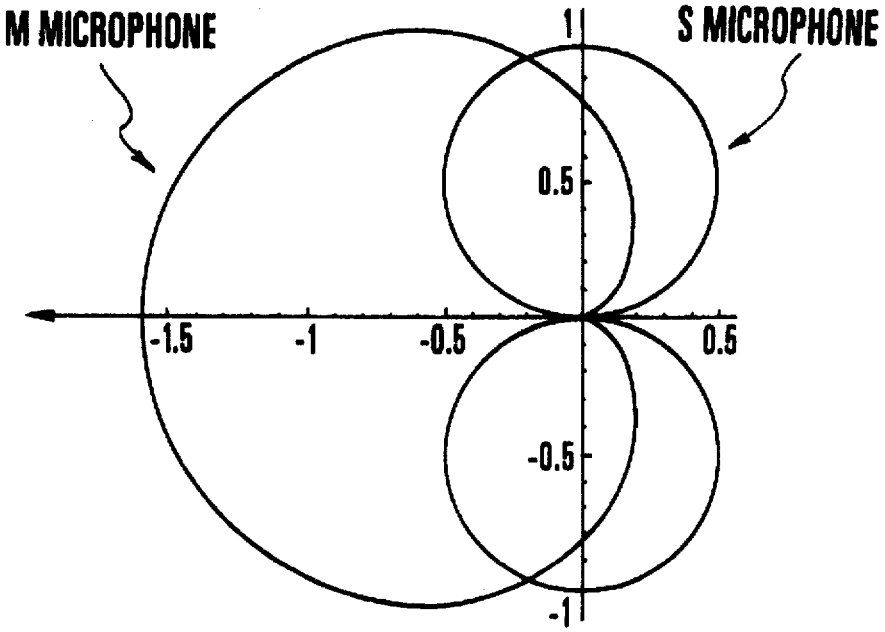
FIG.2 (PRIOR ART)
FIG. 2 shows the directivity patterns of the conventional MS type microphone system.

FIG. 2 shows the directivity patterns of the M and S microphones in the conventional apparatus.

In the narrow directivity mode, the switches 4, 7, 12 and 16 are set to the position N of each switch. In the same manner as above, the signal (L+R) of the M microphone 1 is converted into the digital signal via the A/D converter 18 and fed to the variable amplifier 6 where the digital signal is amplified by K times. The amplified digital signal is sent to the subtracter 9.

Each output of the pair of S microphones 2L, 2R oriented opposite to each other in their directivities is fed to the adder 5 which in turn outputs the sum signal of the outputs of both microphones. The signal (L+R) provided by the adder 5 is converted into the digital signal by the A/D converter 19, and then fed to the variable amplifier 8 to be amplified by (1−K) times. The amplified signal is sent to the subtracter 9. The output signal of the subtracter 9, after being D/A converted by the D/A converter 20, is sent to the output terminal 11 as the signal R. The output signal of the subtracter 9 is also sent, as the signal L, to the output terminal 13 via the position N of the switch 12.

The output signal of the subtracter 9 is also sent, as an error signal, to the control circuit 17 which is designed to control the coefficient K of the variable amplifier 8. In response to the error signal, the control circuit 17 outputs a control signal to the variable amplifier 8 via the N position of the switch 16 in order to control the coefficient K so that the error signal is minimized. This adaptively eliminates the signal picked up by the S microphones 2 out of the output signal provided by the subtracter 9.

The error signal, namely the signal of the M microphone 1 with the signal of the S microphones 2 removed, is D/A converted by the D/A converter 20, and then outputted to the output terminal 11. In a similar manner, the error signal is fed to the D/A converter 21 via the N position of the switch 12, and the resultant analog signal appears at the output terminal 13. In the narrow directivity mode, the left-channel signal and the right-channel signal may be identical.

Figure 4:
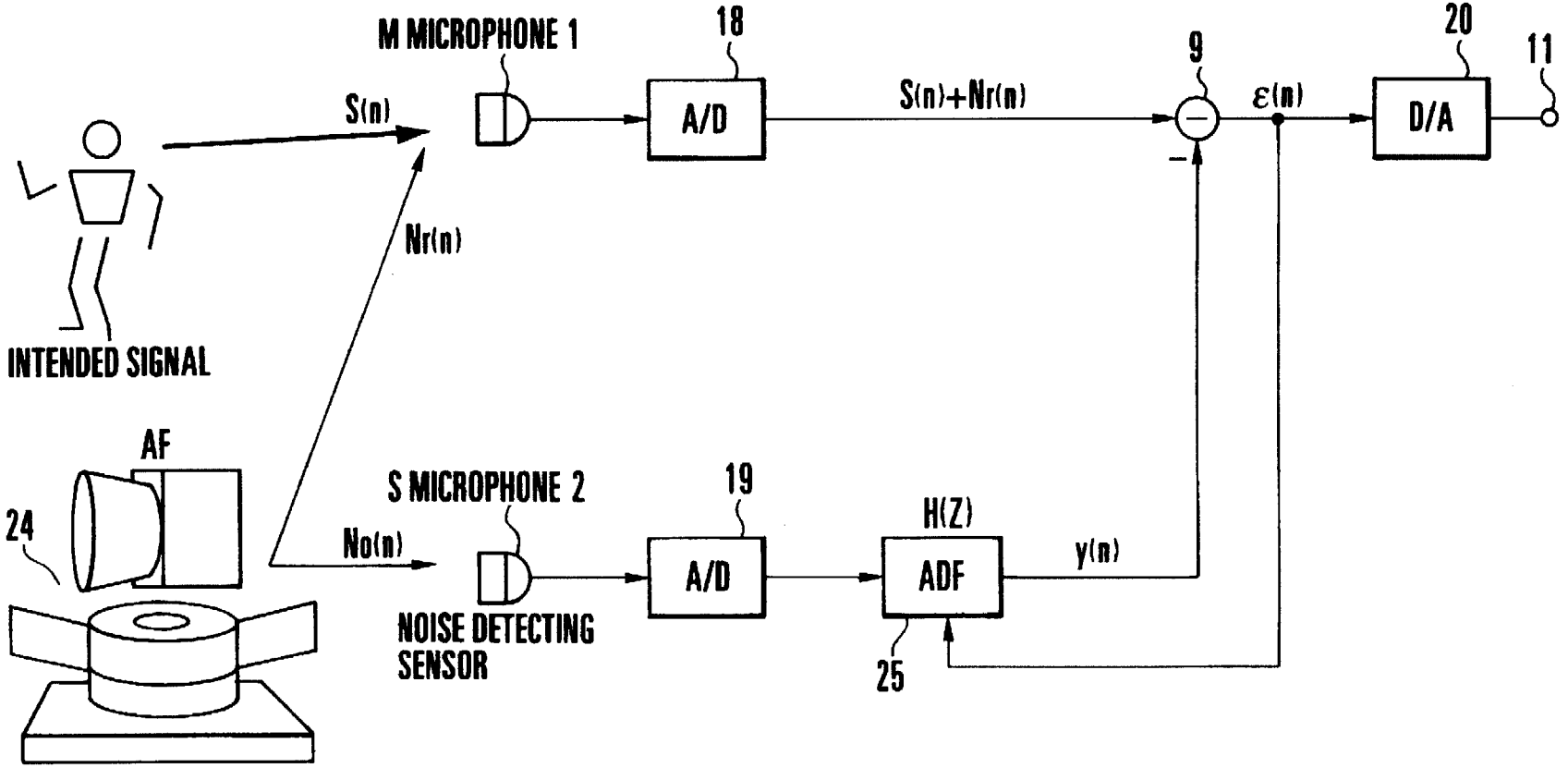
FIG. 4 shows an equivalent structure of the sound input apparatus of FIG. 3 in its narrow directivity operation.

The principle of removing noise adaptively in the narrow directivity mode is discussed referring to FIG. 4. FIG. 4 shows the equivalent diagram showing the construction of FIG. 3 in the narrow directivity mode. Hereinafter, by S(n) and the like are meant a series of discrete-time signals.

In FIG. 4, an intended signal S(n) such as human speeches and noise component Nr(n) are picked up by the M microphone 1, and then converted into the digital signal by the A/D converter 18. During the narrow directivity mode operation, the S microphones 2 function as noise detecting microphones. The S microphones 2, for example, may pick up noise No(n) such as mechanical noise originating at a noise source 24 of a combined camera-VCR unit. The noise No(n) is then converted into the digital signal by the A/D converter 19, and then fed to an adaptive filter 25 having a transfer function H(Z). The adaptive filter 25 gives an output, y(n). The transfer function, H(Z), of the adaptive filter 25 is designed to have a filter coefficient controlled by the noise-free signal, namely, the error signal $\epsilon(n)$ provided by the subtracter 9.

The error signal $\epsilon(n)$ is now discussed.

The output, y(n), of the adaptive filter 25 is fed to the subtracter 9, where the output y(n) is added to the intended signal S(n) and the noise Nr(n). Therefore, the error signal $\epsilon(n)$ is expressed as follows:

$$\epsilon(n)=S(n)+\{Nr(n)-y(n)\} \quad (1)$$

y(n) is expressed by the time convolution of noise No(n) of the noise detecting S microphones 2 and a series of discrete-time signals that is obtained by inverse-Z-transforming the transfer function, H(Z), of the adaptive filter 25. Therefore, $$y(n)=No(n)*Z^{-1}\{H(Z)\} \quad (2)$$

Squared error signal, $\epsilon^2(n)$, is here adopted as a evaluation standard. Even if a coefficient minimizing $\epsilon^2(n)$ is determined, that coefficient is not necessarily optimum at other point of time. Therefore, approximately optimum coefficient is reached by performing a long-term averaging. Mean square error signal $E[\epsilon^2(n)]$ is thus introduced by time averaging $\epsilon^2(n)$, and the coefficient is controlled so that the mean square error signal is minimized.

As described above, the coefficient of the adaptive filter 25 is controlled so that mean square of the error signal, $\epsilon(n)$, namely mean square of the signal without noise component, Nr(n), is minimized. If the second term in Equation (1) is zero, the error signal, $\epsilon(n)$, will become equal to the intended signal, and y(n) will be Nr(n) predicted by the adaptive filter 25. Therefore, y(n) is determined so that the mean square error is minimized.

From Equation (1), the mean square error signal $E[\epsilon^2(n)]$ is expressed as follows:

$$E[\epsilon^2(n)]=E[S^2(n)]+E[\{Nr(n)-y(n)\}^2]-2\times E[\{Nr(n)-y(n)\}\times S(n)] \quad (3)$$

It is assumed that the intended signal, S(n), and noise, Nr(n), and y(n) are independent to each other, and that the long-term average of either of the signals is nearing zero.

The third term in the right-hand side of Equation (3) is almost zero according to the above assumption and can thus be ignored. Therefore, $$E[\epsilon^2(n)]=E[S^2(n)]+E[\{Nr(n)-y(n)\}^2] \quad (4)$$

The second term in Equation (4) is nearing zero by controlling the coefficient of the transfer function, H(Z), of the adaptive filter 25 in such a manner as to minimize the mean square error signal, $E[\epsilon^2(n)]$. The mean square error signal, $E[\epsilon^2(n)]$, therefore approximates the intended signal, S(n).

In this embodiment, the control circuit 17 performs the above arithmetic operation, and the resulting control signal varies the coefficient K of the variable amplifier 8. Its transfer function H(Z) is as follows:

$$H(Z)=(1-K) \quad (5)$$

Figure 5:
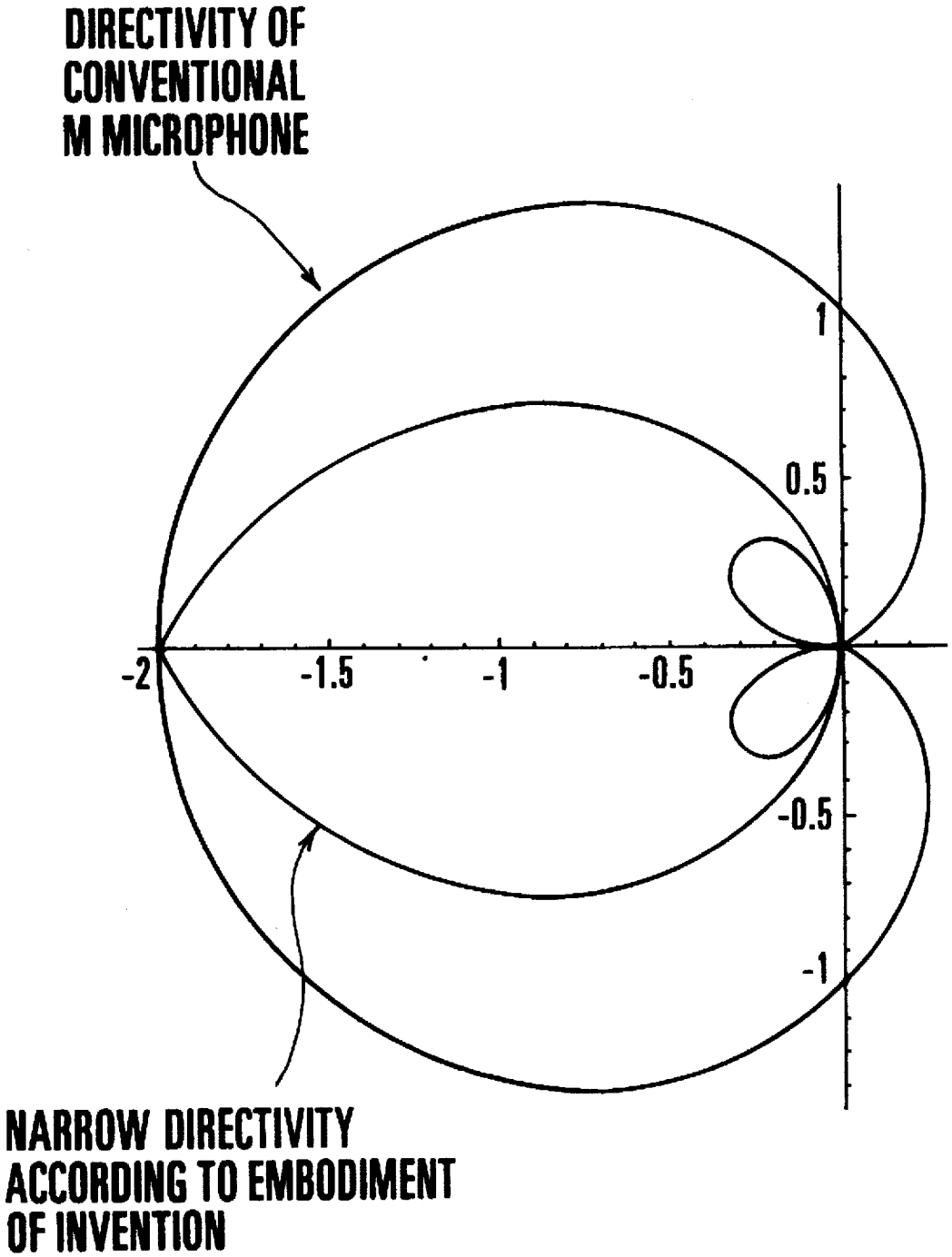
FIG. 5 shows the directivity patterns of the sound input apparatus of FIG. 3 and the directivity patterns of the conventional sound input apparatus.

FIG. 5 shows the directivity characteristics of the conventional M microphone and the narrow directivity characteristics of the present embodiment of the invention. The conventional M microphone, even in its narrowest directivity, cannot be set to be narrower than the directivity of the M microphone. In the present embodiment, however, the directivity is substantially narrower compared to the conventional M microphone, as shown in FIG. 5.

(Second Embodiment)

Figure 6:
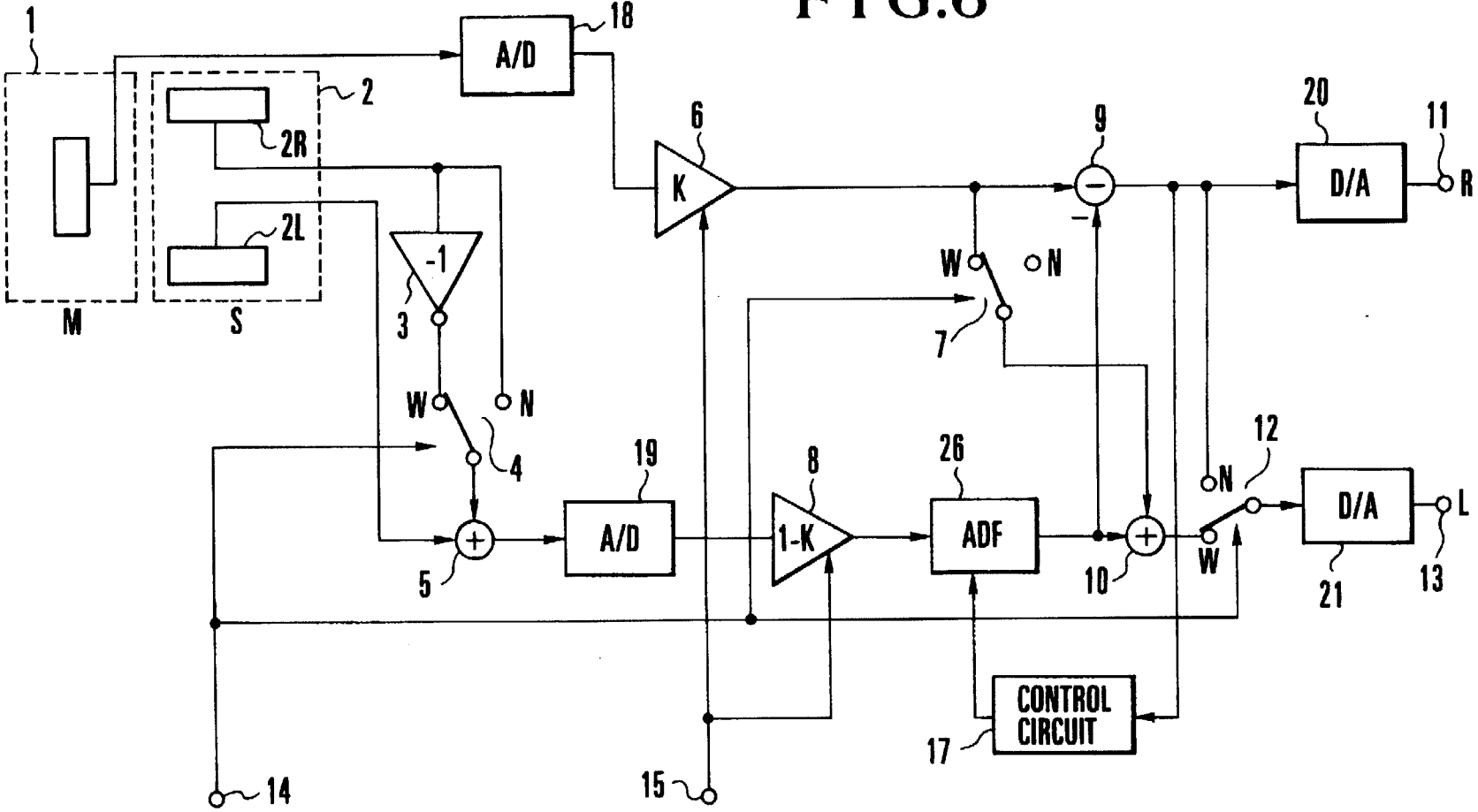
FIG. 6 is a block diagram showing diagrammatically the construction of a second embodiment of the sound input apparatus according to the present invention.

FIG. 6 shows a second embodiment.

In FIG. 6, the switch 16 in FIG. 3 is dispensed with, and an adaptive filter 26 is added to the output side of the variable amplifier 8. The coefficient of the transfer function of the adaptive filter 26 is designed to be controlled by the control circuit 17. The control signal via the coefficient control terminal 15 is designed to be fed to the variable amplifiers 6, 8. The remainder of the arrangement in FIG. 6 remains unchanged from the arrangement of FIG. 3.

The operation of the above arrangement is now discussed.

In the wide directivity mode, the operation remains the same as in the first embodiment. In this case, the control circuit 17 allows its input signal to simply pass through.

The narrow directivity mode is characterized in that the coefficient K of the variable amplifiers 6, 8 is set to a fixed value, 0.5, and that newly provided is a dedicated adaptive filter 26 of which a transfer function coefficient is controlled by the control circuit 17.

Figure 7:
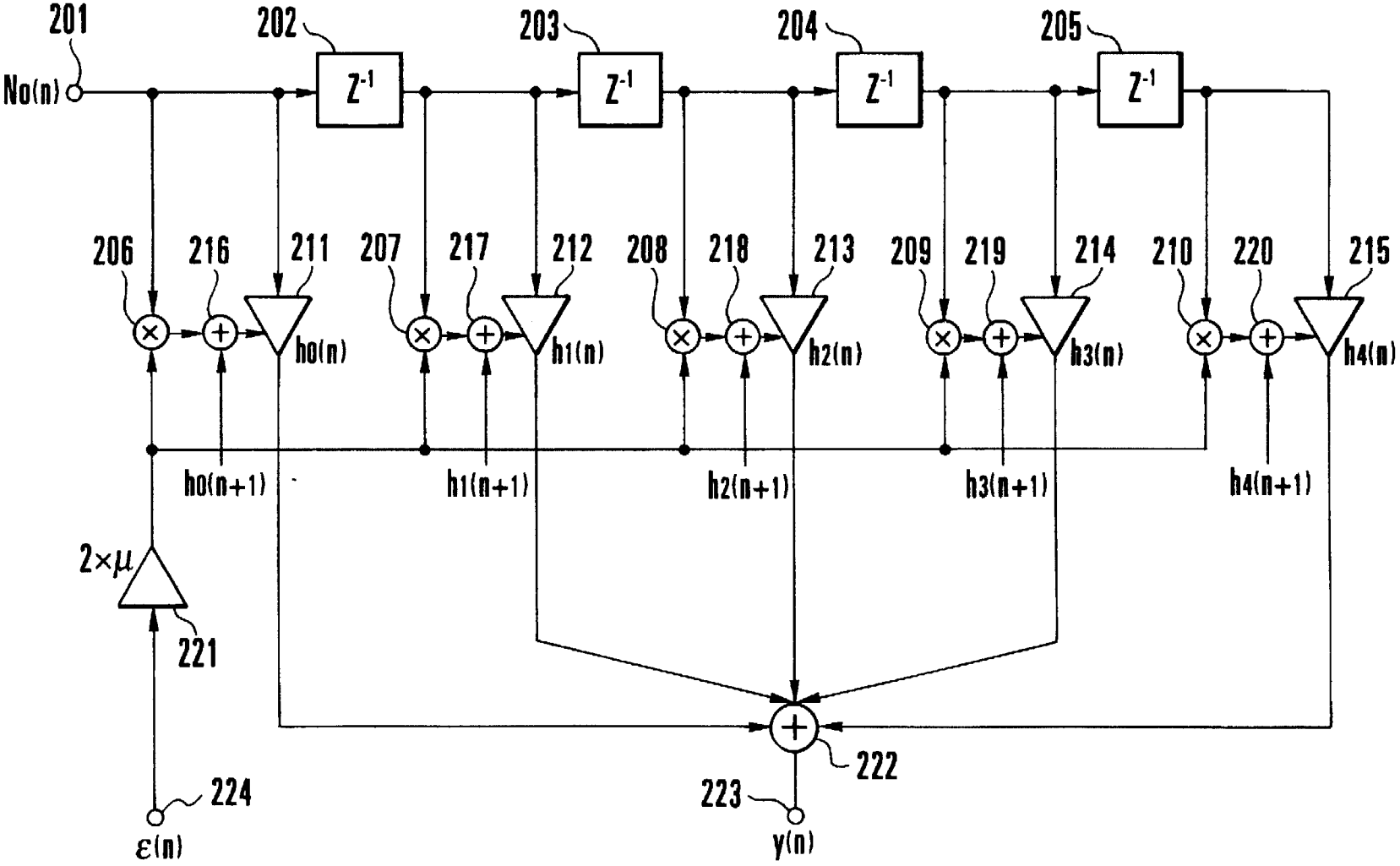
FIG. 7 is a block diagram showing diagrammatically the construction of the FIR adaptive filter shown in FIG. 6.

FIG. 7 is a block diagram of the adaptive filter 26 which is constructed of FIR (Finite Impulse Response) adaptive filter type based on LMS (Least Mean Square) method.

As shown, the FIR adaptive filter is constructed of an input terminal 201 for noise, No(n), an input terminal 224 for an error signal, $\epsilon(n)$, an output terminal 223 for the output signal, y(n), delay elements, for example, four delay elements 202–205 to which the noise, No(n), is sequentially serially transferred, an amplifier 221 for amplifying the error signal $\epsilon(n)$ by $2\mu$ times, multipliers 206–210 for respectively multiplying the amplified outputs by the noise, No(n), and the respective outputs of the delay elements 202–205, adders 216–220 for respectively adding the multiplied outputs and respective coefficients, ho(n+1)–h4(n+1), variable amplifiers 211–215 for controlling the noise, No(n), and the respective outputs of the delay elements 202–206 in response to the respective added outputs, and an adder 222 for adding the outputs of the variable amplifiers 211–215 to obtain the output signal, y(n).

Let H(Z) represent the transfer function of the FIR adaptive filter, then, $$H(Z)=\sum_{i=0}^{N-1} h_i Z^{-i} \quad (6)$$

where $h_i$ is each coefficient of the FIR adaptive filter. As understood from FIG. 7, each coefficient of the FIR adaptive filter varies with time, moment by moment. According to LMS method, each coefficient of the FIR adaptive filter is determined as follows:

$$h_i(n+1)=h_i(n)+2\,\mu\epsilon(n)No(n) \quad (7)$$

where $\mu$ represents a parameter controlling the rate of convergence and stability of the FIR adaptive filter. $\epsilon(n)$ represents a time-series error signal as already mentioned. No(n) represents a time-series noise component signal. $h_i(n)$ represents a time-series of each coefficient of the FIR adaptive filter. In the second embodiment, LMS method is used. Alternatively, Steepest Descent Method, MS (Mean Square) Method and the like may be employed.

To perform digital signal processing in each of the above embodiments, each process may be implemented in hardware. Alternatively, each process may be performed in software using a digital signal processing circuit, so-called DSP.

The M microphone is not limited to a single directivity type having a fixed directivity pattern. The influence of noise may be equally eliminated by the use of the M microphone having variable directivity characteristic, for example, by the use of a microphone array structure.

The directivities of the S microphones 2L, 2R are angled at 90° with respect to the directivity of the M microphone in FIG. 2. Alternatively, the S microphones 2L, 2R may be angled at any other arbitrary angle with respects to the directivity of the M microphone.

According to the present invention, the S microphones function as a noise detecting sensor in the narrow directivity mode operation. No additional noise detecting microphones are thus required in the arrangement of the MS microphone system, and the microphone system as simple as the conventional one offers an improved directivity characteristic in the blocking of ambient noise in its narrow directivity mode. When the present invention may be applied in an apparatus such as a camcorder, the camcorder exhibits a narrower directivity performance than before, with no substantial modification implemented in its microphone arrangement. In such an application, the directivity of sound is expected to well match a viewing angle of an image using a high-magnification zoom lens, and the presence of the image may be enhanced. As another advantage, the microphone system according to the present invention allows narrations or speeches by the user picked up by the S microphones to be adaptively eliminated.

What is claimed is:

1. A sound input apparatus for providing stereophonic sound output comprising:

(a) first sound pick-up means for converting sound into an electrical signal;

(b) second sound pick-up means, disposed to have its maximum directivity to be oriented in a direction different from a direction of maximum directivity of said first sound pick-up means, for converting sound into an electrical signal;

(c) subtraction means for outputting a signal obtained by subtracting an output of said second sound pick-up means from an output of said first sound pick-up means;

(d) level control means for controlling the level of the signal outputted from said second sound pick-up means in accordance with the level of the signal outputted from said subtraction means; and (e) circuit means receiving said signals outputted from said subtraction means and said signal outputted from said second sound pickup means for providing first and second stereophonic output signals.

2. A sound input apparatus according to claim 1, wherein said first sound pick-up means includes a first microphone disposed to allow its maximum directivity to be oriented in a desired direction.

3. A sound input apparatus according to claim 2, wherein said second sound pick-up means includes a second microphone disposed to allow its maximum directivity to be oriented in a direction different from the direction of the maximum directivity of the first microphone.

4. A sound input apparatus according to claim 2, wherein said second sound pick-up means includes:

(a) a pair of second microphones disposed to allow their maximum directivities to be oriented in directions different from the direction of the maximum directivity of the first microphone; and (b) addition means for outputting a signal obtained by adding outputs of the second microphones.

5. A sound input apparatus according to claim 4, wherein said level control means includes amplifying means for amplifying the signal outputted from said addition means according to an amplification factor corresponding to the level of the signal outputted from said subtraction means and for supplying the amplified signal to said subtraction means.

6. A sound input apparatus comprising:

(a) a first microphone disposed to allow its maximum directivity to be oriented in a desired direction;

(b) first coefficient multiplying means for multiplying a signal outputted from said first microphone by an arbitrary coefficient to output a resultant signal;

(c) a pair of second microphones disposed to allow their maximum directivities to be oriented in directions different from the direction of the maximum directivity of said first microphone;

(d) arithmetic processing means for performing adding or subtracting operation between outputs of said second microphones to output a resultant signal;

(e) second coefficient multiplying means for multiplying the signal outputted from said arithmetic processing means by an arbitrary coefficient to output a resultant signal;

(f) subtraction means for outputting, as a first channel signal, a signal obtained by subtracting the signal outputted from said second coefficient multiplying means from the signal outputted from said first coefficient multiplying means;

(g) addition means for outputting, as a second channel signal, a signal obtained by adding the signal outputted from said second coefficient multiplying means and the signal outputted from said first coefficient multiplying means; and (h) setting means provided with a first sound pick-up mode in which sound is picked up in a first directivity and a second sound pick-up mode in which sound is picked up in a second directivity which is narrower than the first directivity, for performing the setting corresponding to either of the two sound pick-up modes, wherein said setting means, in the first sound pick-up mode, sets said arithmetic processing means to output a signal obtained by performing subtracting operation between the outputs of said second microphones, and said setting means, in the second sound pick-up mode, sets said arithmetic processing means to output a signal obtained by performing adding operation between the outputs of said second microphones, allows said subtraction means to output, as a first channel signal and a second channel signal, a signal obtained by subtracting the signal outputted from said second coefficient multiplying means from the signal outputted from said first coefficient multiplying means, and allows said second coefficient multiplying means to output a signal obtained by multiplying the signal outputted from said arithmetic processing means by a coefficient corresponding to the level of the signal outputted from said subtraction means.

7. A sound input apparatus according to claim 6, being arranged so that the directivity of the apparatus varies in the first sound pick-up mode by varying the coefficients with which said first and second coefficient multiplying means perform multiplication.

8. A sound input apparatus according to claim 6, wherein said first channel signal is a right audio signal and said second channel signal is a left audio signal.

9. A sound input apparatus comprising:

(a) a first microphone disposed to allow its maximum directivity to be oriented in a desired direction;

(b) first coefficient multiplying means for multiplying a signal outputted from said first microphone by an arbitrary coefficient to output a resultant signal;

(c) a pair of second microphones disposed to allow their maximum directivities to be oriented in directions different from the direction of the maximum directivity of said first microphone;

(d) arithmetic processing means for performing adding or subtracting operation between outputs of said second microphones to output a resultant signal;

(e) second coefficient multiplying means for multiplying the signal outputted from said arithmetic processing means by an arbitrary coefficient to output a resultant signal;

(f) filter means for filtering the signal outputted from said second coefficient multiplying means to output a resultant signal;

(g) subtraction means for outputting, as a first channel signal, a signal obtained by subtracting the signal outputted from said filter means from the signal outputted from said coefficient multiplying means;

(h) addition means for outputting, as a second channel signal, a signal obtained by adding the signal outputted from said filter means and the signal outputted from said first coefficient multiplying means; and (i) setting means provided with a first sound pick-up mode in which sound is picked up in a first directivity and a second sound pick-up mode in which sound is picked up in a second directivity which is narrower than the first directivity, for performing the setting corresponding to either of the two sound pick-up modes, wherein said setting means, in the first sound pick-up mode, sets said arithmetic processing means to output a signal obtained by performing subtracting operation between the outputs of said second microphones, and said setting means, in the second sound pick-up mode, sets said arithmetic processing means to output a signal obtained by performing adding operation between the outputs of said second microphones, allows said subtraction means to output, as a first channel signal and a second channel signal, a signal obtained by subtracting the signal outputted from said filter means from the signal outputted from said first coefficient multiplying means, and allows said filter means to output a signal obtained by filtering the signal outputted from said second coefficient multiplying means according to a filter characteristic corresponding to the level of the signal outputted from said subtraction means.

10. A sound input apparatus according to claim 9, being arranged so that the directivity of the apparatus varies in the first sound pick-up mode by varying the coefficients with which said first and second coefficient multiplying means perform multiplication.

11. A sound input apparatus according to claim 9, wherein said first channel signal is a right audio signal and said second channel signal is a left audio signal.

12. A sound input apparatus having respective wide and narrow directional modes of operation comprising:

(a) first sound pick-up means for converting sound into an electrical signal;

(b) a pair of second sound pick-up means, disposed to have their maximum directivities to be oriented in directions different from a direction of maximum directivity of said first sound pick-up means, for converting sound into electrical signals; and (c) switching means for additively combining electrical signals generated by said pair of second sound pick-up means in said narrow directional mode of said apparatus and for subtractively combining electrical signals generated by said pair of second sound pick-up means in said wide directional mode of said apparatus.

13. A sound input apparatus according to claim 12, further including subtraction means for inputting both a signal obtained from said switching means in each of said narrow and wide directional modes and a signal generated by said first sound pick-up means.

14. A sound input apparatus according to claim 12, further including addition means operative exclusively in said wide directional mode of said apparatus for inputting both a signal obtained from said switching means in said wide directional mode and a signal generated by said first sound pick-up means.

15. A sound input apparatus according to claim 13, further including addition means operative exclusively in said wide directional mode of said apparatus for inputting both a signal obtained from said switching means in said wide directional mode and a signal generated by said first sound pick-up means.

* * * * *